US006216605B1

(12) United States Patent
Chapman

(10) Patent No.: US 6,216,605 B1
(45) Date of Patent: Apr. 17, 2001

(54) MULTI-PURPOSE HIGH CHAIR TRAY CONSTRUCTION

(76) Inventor: Marian D. Chapman, 123 N. Oak Ave., Clifton Heights, PA (US) 19018

( * ) Notice: Subject to any disclaimer, the term of this patent is extended or adjusted under 35 U.S.C. 154(b) by 0 days.

(21) Appl. No.: 09/440,981

(22) Filed: Nov. 16, 1999

(51) Int. Cl.[7] ..... A47B 85/00
(52) U.S. Cl. ..... 108/26; 297/153
(58) Field of Search ..... 108/25, 26, 45, 108/44, 43; 297/153; 224/567, 148.4

(56) References Cited

U.S. PATENT DOCUMENTS 1,242,785 * 10/1917 Eldridge .
2,646,575 * 7/1953 Galley .
2,684,110 * 7/1954 Stone .
3,143,374 8/1964 Carboni .
3,148,636 * 9/1964 Bloomquist et al. .
3,745,303 * 7/1973 Epperson et al. .
4,606,576 8/1986 Jones .
4,907,539 * 3/1990 Abulhasan .
4,908,066 * 3/1990 Taylor et al. .
5,071,149 * 12/1991 Perego .
5,458,394 10/1995 Nichols et al. .
5,558,391 9/1996 Cahvous .
5,586,800 12/1996 Triplett .
5,720,226 * 2/1998 Padovano .

* cited by examiner

*Primary Examiner*—Jose V. Chen
(74) *Attorney, Agent, or Firm*—Henderson & Sturm LLP

(57) ABSTRACT

A tray construction (10) for use on a conventional high chair (100) wherein the tray construction (10) includes a tray member (20) having a top surface (21) provided with a contoured central recess (22) having a plurality of J-shaped slots (23) that open into keyways (24) that are dimensioned to receive suitably configured tangs (34) which project outwardly from the base element (33) of a food receptacle (31) having a lip (32) that is attached to a plurality of tethered accessory units (13) which include eating utensil members (40) and drinking receptacle members (50).

15 Claims, 2 Drawing Sheets

MULTI-PURPOSE HIGH CHAIR TRAY CONSTRUCTION

BACKGROUND OF THE INVENTION

1. Field of the Invention

The present invention relates to the field of specialized trays for high chairs in general, and in particular to a high chair tray having releasable engaging means to accommodate a variety of accessories.

2. Description of Related Art

As can be seen by reference to the following U.S. Pat. Nos. 3,143,374; 4,606,576; 5,458,394; 5,558,391; and 5,586,800, the prior art is replete with myriad and diverse high chair constructions having trays adapted to releasably receive a variety of receptacles.

While all of the aforementioned prior art constructions are more than adequate for the basic purpose and function for which they have been specifically designed, they are uniformly deficient with respect to their failure to provide a simple, efficient, and practical high chair tray construction that is designed to releasably secure receptacles wherein the receptacles are provided with tethered utensils.

As any parent or caregiver is all too well aware, young infants and small children are extremely prone to spilling food receptacles and/or knocking the receptacles and eating utensils from the high chair tray onto the floor.

As a consequence of the foregoing situation, there has existed a longstanding need for a new and improved type of high chair tray construction wherein a central food receptacle is captively secured in a stationary location on the surface of the tray and further provided with utensils and auxiliary receptacles that are tethered to the main food receptacle in a satellite fashion, and the provision of such a construction is a stated objective of the present invention.

BRIEF SUMMARY OF THE INVENTION

Briefly stated, the multi-purpose high chair tray construction that forms the basis of the present invention comprises in general, a tray unit adapted for use on a conventional high chair wherein t he tray unit is adapted to releasably receive a base unit which is further provided with a plurality of tethered accessory units.

As will be explained in greater detail further on in the specification, the tray unit comprises a tray member having a contoured central recess provided with a plurality of radially projecting J-shaped slots which are dimensioned to releasably receive portions of the base unit.

In the preferred embodiment of the invention, the base unit comprises an enlarged food receptacle whose bottom is dimensioned to be received in the central portion of the recess and is further provided with a plurality of horizontally disposed J-shaped tangs which are dimensioned to drop through the J-shaped slots and then be rotated into engagement with the interior of the tray member.

In addition, the upper portion of the base unit is provided with a plurality of discrete apertures which are dimensioned to receive the captive end of the tethered accessory units which in the preferred embodiment of the invention includes eating utensil members such as forks and spoons and drinking receptacle members such as bottles and drinking cups.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
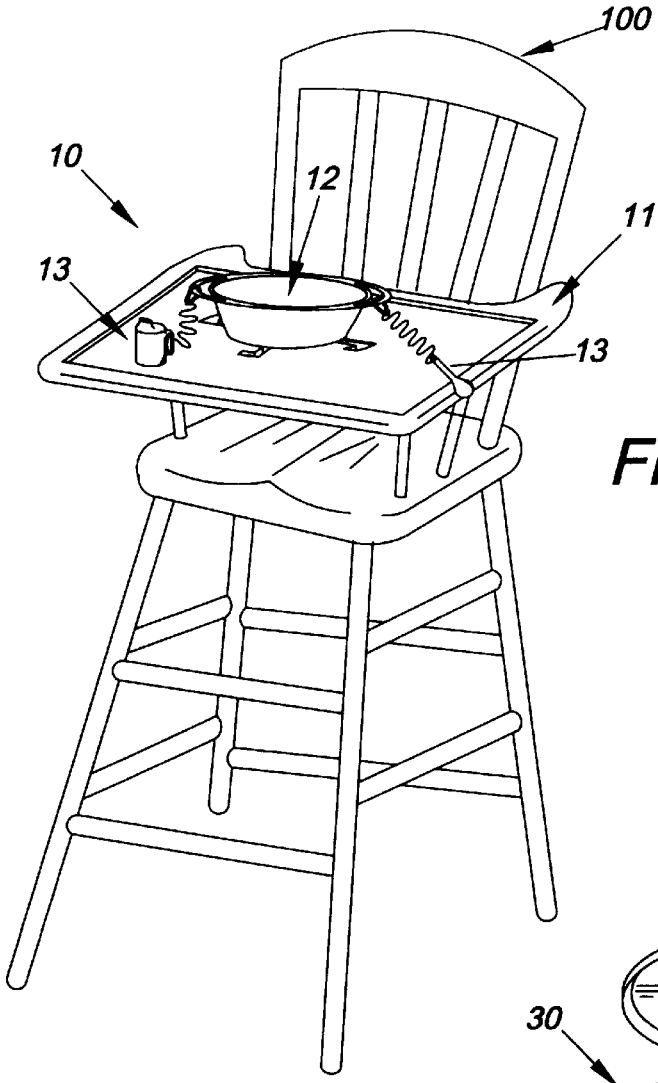
FIG. 1 is a perspective view of the tray construction attached to a conventional high chair.

As can be seen by reference to the drawings, and in particular to FIG. 1, the high chair tray construction that forms the basis of the present invention is designated generally by the reference number 10. The tray construction comprises in general, a tray unit 11, a base unit 12, and a plurality of tethered accessory units 13. These units will now be described in seriatim fashion.

Figure 2:
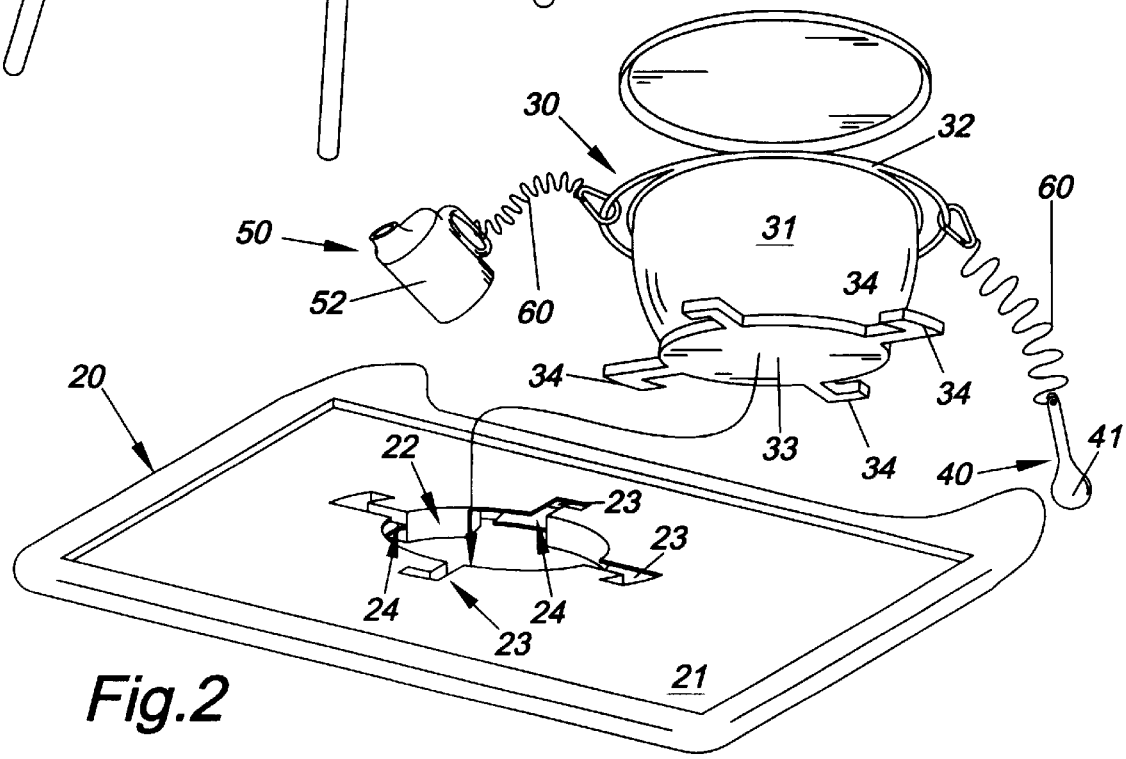
FIG. 2 an isolated exploded perspective view of the tray construction.
Figure 3:
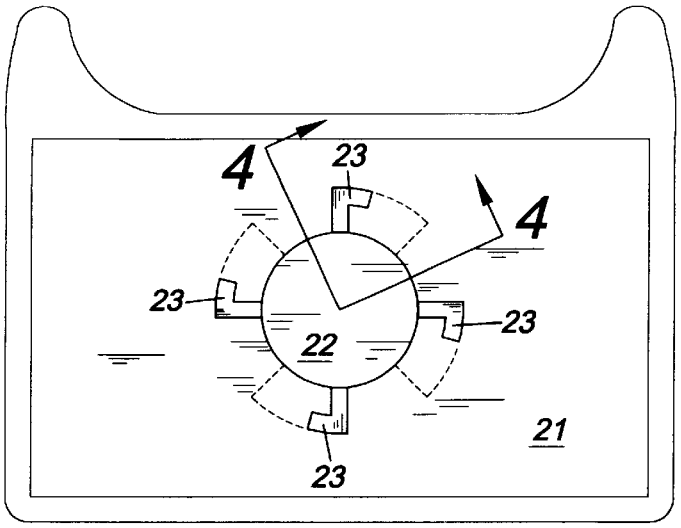
FIG. 3 is a top plan view of the tray unit.

As shown in FIGS. 1 through 3, the tray unit comprises a tray member 20 of conventional design having a top surface 21 provided with an enlarged contoured central recess 22 provided with a plurality of generally J-shaped slots 23 formed in the top surface 21 of the tray member 20 and projecting outwardly in a generally radial fashion from the periphery of the central recess.

Figure 4:
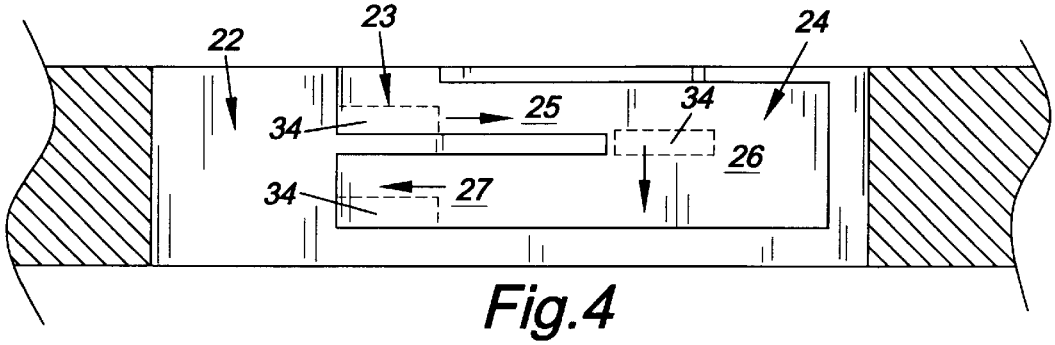
FIG. 4 is a cross sectional view of the interior one of the tray slots taken through line 4—4 of FIG. 3.
Figure 5:
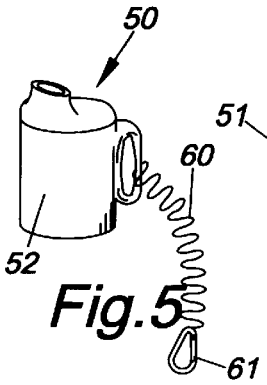
FIGS. 5 and 6 are isolated perspective views of different drinking receptacle members,that can be employed in the invention.
Figure 6:
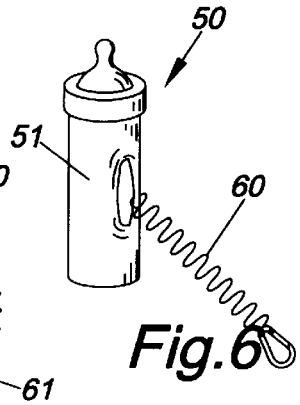

Furthermore, as can be seen by reference to FIGS. 3 and 4, the J-shaped slots 23 form the opening into a tortuous multi-tiered keyway designed generally as 24 and having an upper horizontal race 25, a vertical intermediate race 26 disposed on the outboard end of the upper race 25 and a lower horizontal race 27 that is disposed beneath the upper horizontal race 25 for reasons that will be explained presently.

Turning back to FIGS. 1 and 2, it can be seen that in the preferred embodiment of the invention, the base unit 12 comprises an enlarged foot receptacle member 30 such as a bowl 31 or the like having an apertured rim 32 formed on its upper end and provided with a generally cylindrical base element 33 formed on its lower end. The external periphery of the lower end of the base element 33 is further provided with a plurality of J-shaped tang elements 34 which are dimensioned to be received in the J-shaped slots 23 formed in the top surface 21 of the tray member 20.

In order to properly engage the base unit 12 with the tray unit 11, an adult would position the base unit 11 such that the tang elements 34 will drop through the apertures 23 onto the upper horizontal race 25. The base unit 12 would then be rotated so that the tang elements 34 would be positioned above the vertical race 26 and then dropped downwardly once more into alignment with the lower horizontal race 27. Then the base unit 12 would be rotated in the opposite direction to releasably lock the base unit 12 into the tray unit 11 so as to prevent a child from disengaging the base unit 12 from the tray unit 11.

As shown in FIGS. 1, 2, 5, and 6, the plurality of tethered accessory units 13 comprise eating utensil members 40 such as spoons 41 and forks (not shown) and drinking receptacle members 50 such as baby bottles 51 and drinking cups 52.

Each of the eating utensil members 40 and drinking receptacle members 50 are provided with a resilient tether member 60 provided with clips 61 that are releasably engaged with a handle element 32 of the enlarged food receptacle member 30.

In this manner, once the food receptacle member 30 is engaged with the tray member 20, an infant not only cannot dislodge the food receptacle member 30 from the tray member 20, but the child or infant also cannot throw the tethered eating utensil members 40 or the tethered drinking receptacle members 50 in such a manner that the resilient tether members 60 will not return those tethered accessory units 13 back onto the top surface 21 of the tray member 20.

Figure 7:
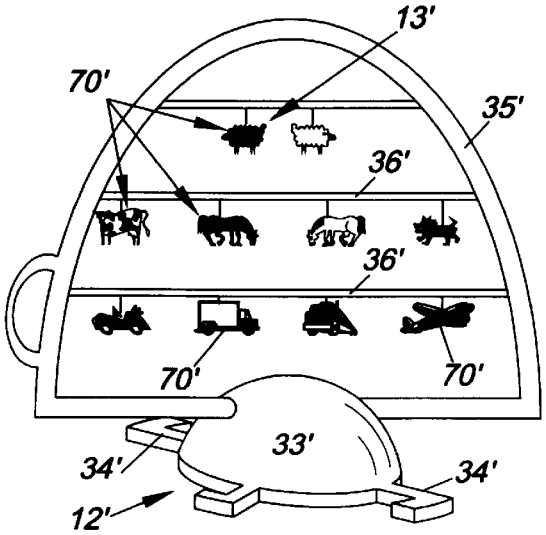
FIG. 7 is a perspective view of an alternate version of the base unit and the tethered accessory units.

In the alternate version of the preferred embodiment depicted in FIG. 7, it can be seen that the base unit 12' has a dome shaped base element 33' having a plurality of J-shaped tang elements 34 projecting outwardly therefrom. The upper portion of the dome shaped base element 33' is provided with a contoured framework member 35' provided with a plurality of cross arms 36' which support a plurality of tethered accessory units 13'. The plurality of tethered accessory units 13' comprise a plurality of differently configured mobile elements 70' that are intended to amuse the child while the adult is preparing their meals.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A tray construction for use with a conventional high chair wherein the tray construction comprises:

a tray unit including a tray member having a top surface provided with a central recess;

a base unit including a base element adapted to be captively engaged in said central recess wherein the base unit comprises a dome shaped base element having an upper portion provided with a contoured framework member having a plurality of cross arms; and a plurality of tethered accessary units attached to said base unit.

2. The tray construction as in claim 1 wherein the base unit includes a food receptacle member having a lower end connected to said base element.

3. The tray construction as in claim 2 wherein said plurality of tethered accessory units includes at least one eating utensil member.

4. The tray construction as in claim 3 wherein said plurality of tethered accessory units includes at least one drinking receptacle member.

5. The tray construction as in claim 4 wherein said at least one drinking receptacle member is selected from among a baby bottle and a drinking cup.

6. The tray construction as in claim 4 wherein said at least one eating utensil member is selected from among a spoon and a fork.

7. The tray construction as in claim 6 wherein said at least one drinking receptacle member is selected from among a baby bottle and a drinking cup.

8. The tray construction as in claim 4 wherein the central recess is provided with a plurality of outwardly projecting generally J-shaped slots.

9. The tray construction as in claim 8 wherein the base element is provided with a plurality of outwardly projecting J-shaped tangs which are dimensioned to be received in the plurality of J-shaped slots.

10. The tray construction as in claim 9 wherein each of the J-shaped slots form an opening into a contoured keyway.

11. The tray construction as in claim 10 wherein each keyway includes a horizontal race and a vertical race.

12. The tray construction as in claim 10 wherein each keyway includes an upper horizontal race, an intermediate vertical race and a lower horizontal race.

13. The tray construction as in claim 3 wherein said at least one eating utensil member is selected from among a spoon and a fork.

14. The tray construction as in claim 2 wherein the food receptacle member has an upper end provided with at least one peripheral handle which is connected to said plurality of tethered accessory units.

15. The tray construction as in claim 1 wherein said plurality of tethered accessory units comprise a plurality of mobile elements.

* * * * *